US007579999B2

(12) United States Patent
Boβ et al.

(10) Patent No.: US 7,579,999 B2
(45) Date of Patent: Aug. 25, 2009

(54) DUAL POLARIZED DIPOLE RADIATOR

(75) Inventors: Michael Boβ, Riedering (DE); Maximilian Götti, Frasdorf (DE); Mario Günther, Koblermoor (DE); Johann Obermaier, Weiching (DE)

(73) Assignee: Kathrein-Werke KG, Rosenheim (DE)

( * ) Notice: Subject to any disclaimer, the term of this patent is extended or adjusted under 35 U.S.C. 154(b) by 356 days.

(21) Appl. No.: 11/542,244

(22) Filed: Oct. 4, 2006

(65) Prior Publication Data

US 2007/0080883 A1 Apr. 12, 2007

(30) Foreign Application Priority Data

Oct. 6, 2005 (DE) ..... 20 2005 015 708 U

(51) Int. Cl.
*H01Q 21/20* (2006.01)

(52) U.S. Cl. ..... 343/799; 343/795

(58) Field of Classification Search ..... 343/795, 343/797, 799, 803, 806
See application file for complete search history.

(56) References Cited

U.S. PATENT DOCUMENTS

| | | | | |
|---|---|---|---|---|
| 6,313,809 | B1 | 11/2001 | Gabriel et al. | |
| 6,697,029 | B2 | 2/2004 | Teillet et al. | |
| 6,822,618 | B2 * | 11/2004 | Bisiules et al. | 343/803 |
| 6,940,465 | B2 | 9/2005 | Gottl et al. | |
| 2002/0163476 | A1 | 11/2002 | Eriksson | |
| 2002/0163477 | A1 * | 11/2002 | Eriksson | 343/815 |
| 2004/0201537 | A1 | 10/2004 | Stolle et al. | |
| 2004/0263392 | A1 * | 12/2004 | Bisiules et al. | 343/700 MS |
| 2004/0263410 | A1 | 12/2004 | Teillet et al. | |
| 2007/0241983 | A1 * | 10/2007 | Cao et al. | 343/797 |
| 2008/0111757 | A1 * | 5/2008 | Bisiules et al. | 343/799 |

FOREIGN PATENT DOCUMENTS

| | | | |
|---|---|---|---|
| DE | 9104722.6 | U1 | 9/1991 |
| DE | 19860121 | A1 | 7/2000 |
| DE | 10320621 | A1 | 12/2004 |
| EP | 0994524 | B1 | 2/2003 |
| EP | 1057224 | B1 | 10/2003 |
| EP | 0709913 | A2 | 11/2006 |
| WO | WO03103086 | A2 | 12/2003 |
| WO | WO2004001902 | A1 | 12/2003 |
| WO | WO2004055938 | A2 | 7/2004 |

* cited by examiner

*Primary Examiner*—HoangAnh T Le
(74) *Attorney, Agent, or Firm*—Nixon & Vanderhye P.C.

(57) ABSTRACT

An improved dual polarized radiator is distinguished, inter alia, by the following features: the dual polarized dipole radiator is made from a strip and/or board material, in particular a metal sheet, the dual polarized dipole radiator is constructed in one piece, and the individual portions of the dual polarized dipole radiator, including the dipole components, the feed arms, the support portions forming the balun and an associated base connecting the support portions, are connected to one another by bending and/or tilting and/or folding lines formed in the sheet-like basic material.

26 Claims, 12 Drawing Sheets

DUAL POLARIZED DIPOLE RADIATOR

The invention relates to a dual polarized dipole radiator.

A generic dipole radiator has become known from EP 1 057 224 B1. This is what is known as a vector dipole which radiates electrically like a turnstile dipole. Structurally, however, this vector dipole simulates a dipole square, the polarization planes, which are oriented perpendicularly to one another, being located on the diagonals of the dipole square-like radiator.

A dual polarized dipole radiator construction of this type has allowed significant improvements and progress to be made over earlier solutions.

A dual polarized dipole radiator of this type preferably consists of a cast or milled part in order, in particular, to prevent undesirable intermodulations.

Starting from this generic prior art, the object of the present invention is to provide a correspondingly dual polarized dipole radiator which may be produced more simply and cost-effectively.

According to the invention, the object is achieved in accordance with the features specified in Claim 1. Advantageous embodiments of the invention are specified in the sub-claims.

The invention provides a vector dipole which, despite its complex structure, may ultimately be produced from a sheet metal part, for example by punching or cutting and subsequent bending and tilting. The entire dual polarized radiator for both polarizations, including all eight dipole components, is produced from a base plate or a base metal sheet. As no parts have to be screwed on, welded on or soldered on, there are also no intermodulation problems. The dual polarized radiator according to the invention may therefore be produced cost-effectively.

In principle, US 2002/0163476 A1 discloses a dual polarized dipole radiator comprising dipoles or dipole components which are punched from a sheet metal part and are located in the radiator plane. The carrier means or what is known as the balun is, in turn, produced from a separate part. In other words, use is made only of dipole radiators which are punched from a sheet metal part and are located in the radiation plane, without this sheet metal part being tilted or multiply tilted, forming one or more tilting or bending lines, thus preventing the advantages according to the invention from being achieved, as a plurality of individual parts still have to be joined, i.e. for example to the balun which, according to this prior publication, is to be connected to the dipole radiators by bonding, soldering or brazing.

Further optimization and, in particular, savings in the amount of basic material required may be achieved within preferred solutions according to the sub-claims. This results, inter alia, from the specific configuration of the bending or tilting axes by means of which the dipole components are constructed, forming the dipole halves.

Finally, further reinforcement of the balun is obtained in that the balun is provided, over its entire length or in a range of greater than 50%, preferably greater than 60%, 70%, 80% or even 90% of its length, with lateral bending edges which stabilize the balun acting as the support means and, in addition, align the support arms serving to feed the dipole components.

Further advantages, details and features of the invention will emerge hereinafter from the embodiments shown in the drawings, in which specifically:

Structurally and electrically, the basic construction of the vector dipole corresponds to that known from EP 1 057 224 B1, to the disclosure of which, which is thereby incorporated into the content of the present application, reference is therefore made.

Figure 1:
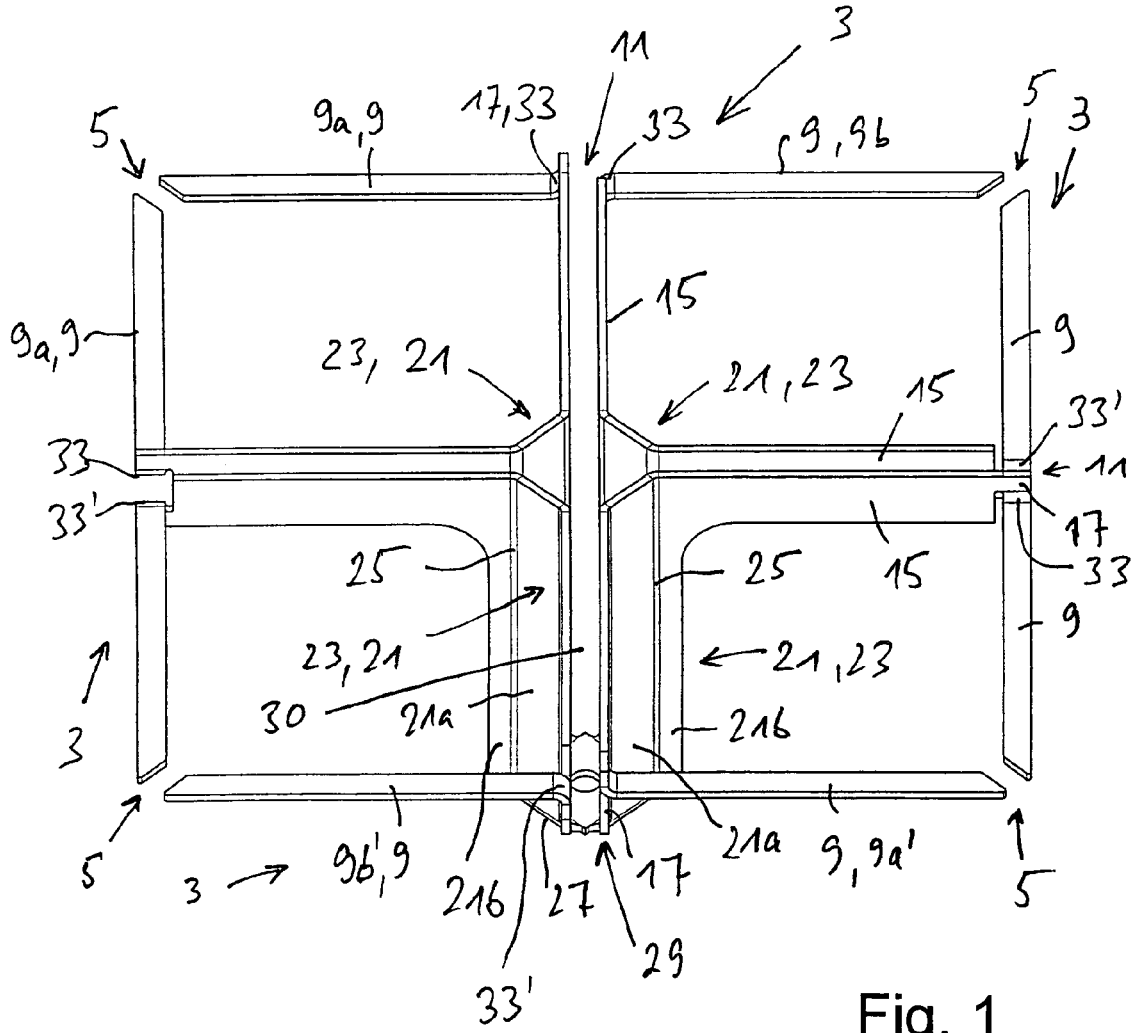
FIG. 1 is a schematic, perspective view of a first embodiment according to the invention of a fully curved, tilted or folded dual polarized vector dipole.
Figure 2:
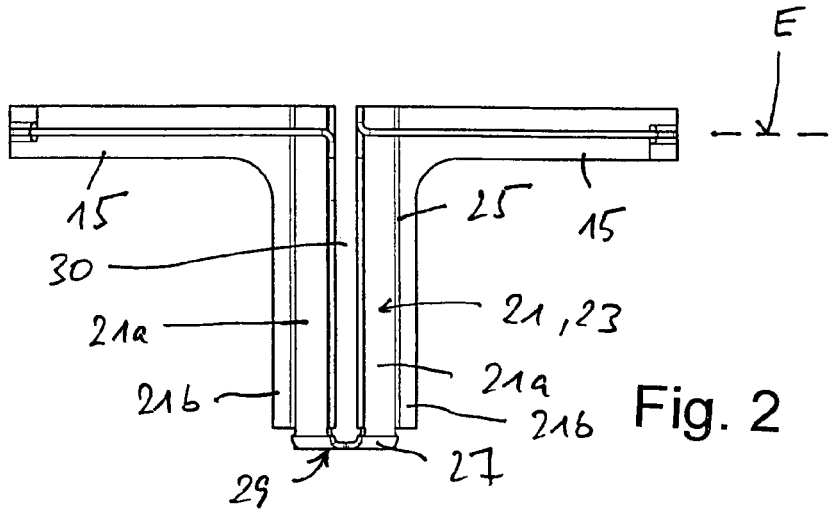
FIG. 2 is a schematic, perspective plan view of the embodiment according to FIG. 1.
Figure 3:
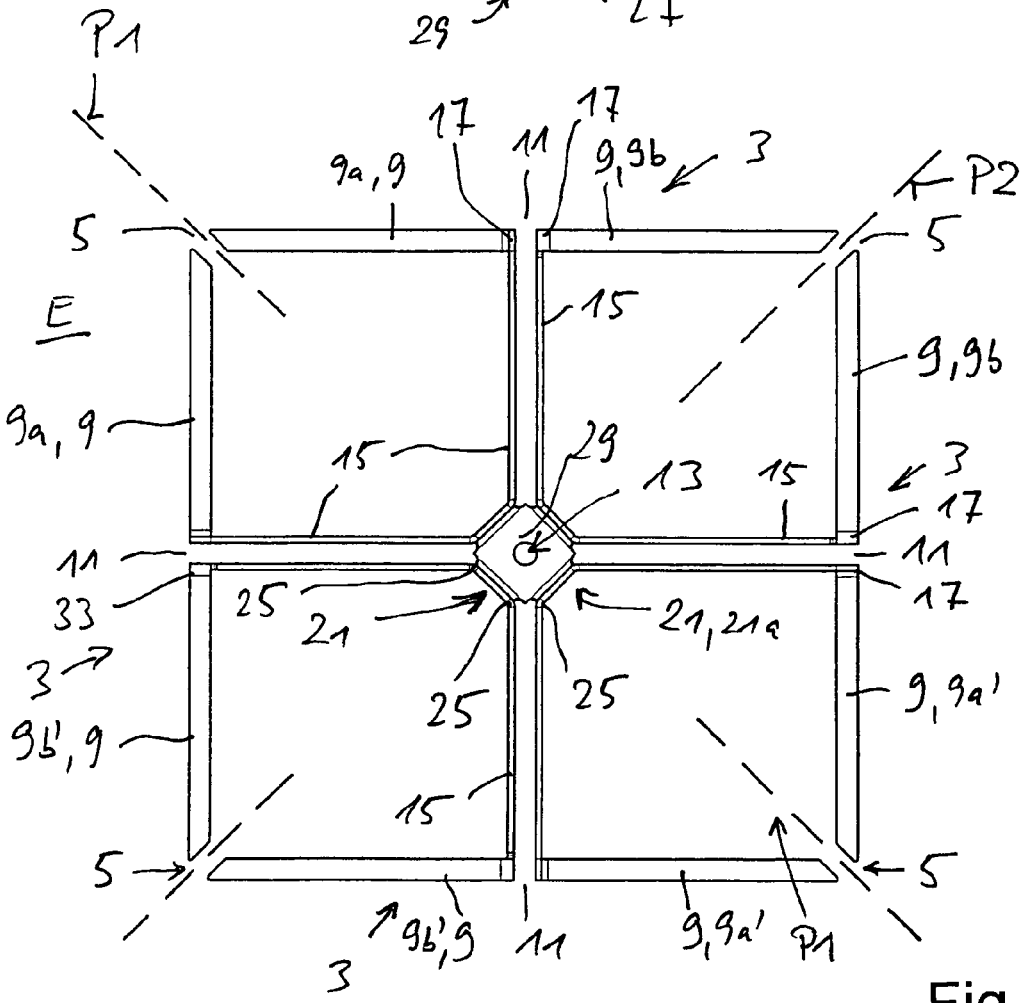
FIG. 3 is a schematic side view of the embodiment of the invention according to FIGS. 1 and 2.
Figure 4:
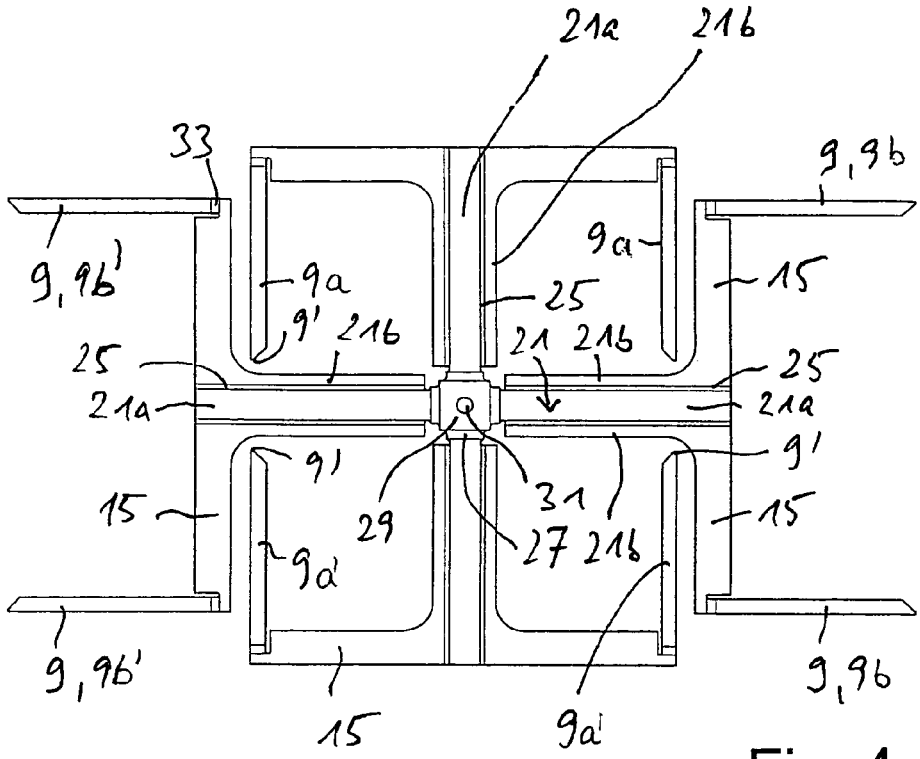
FIG. 4 is a plan view of the dual polarized vector dipole shown in FIGS. 1 to 3, in the developed position after cutting or punching from a two-dimensional material prior to the carrying-out of a bending, tilting and/or folding process.

The finished vector dipole according to FIGS. 1 to 3, therefore, has the following construction:

The vector dipole consists of a dual polarized dipole which radiates in two polarization planes P1 and P2 located perpendicularly to one another (FIG. 4).

Structurally, the dual polarized dipole radiator simulates a dipole square, with four sides 3, thus forming corner regions 5.

Between each two adjacent corner regions 5 on each side 3 there are arranged two respective dipole components 9 which are located substantially in the axial extension and conventionally also in an identical plane and each extend between a central region 11 on each side 3 and a corner region 5.

A vector dipole thus formed acts electrically in a similar manner to a turnstile dipole, the two perpendicular or substantially perpendicular polarization planes P1 and P2 of which are located on the diagonals of a square similar to a dipole square. In other words, the polarization planes P1 and P2 therefore extend in a crosswise manner through the corner regions 5 and a centre 13.

The vector dipole according to FIGS. 1 to 3 is fed as described in EP 1 057 224 B1, so reference is made to this prior publication. The directions of the polarization planes of the radiated waves are parallel to the above-mentioned diagonals, wherein for each polarization all four dipoles, i.e. all eight dipole components 9 on the outsides of the square, are stimulated. Two dipole components 9 of this type, extending perpendicularly to one another, are fed via two feed arms 15 which, in the embodiment shown, at least in plan view, extend approximately perpendicularly to the dipole components 9 held thereby and extend from a central region 11 on a side 3, i.e. a feed point 17 provided in this location, in each case, with respect to an associated dipole component 9, in a centrally arranged support portion 21.

It may therefore be seen from the construction that two respective dipole components 9, oriented perpendicularly to one another and extending to a common corner region 5, are held via two feed arms 15, also extending, at least in plan view, perpendicularly or approximately perpendicularly to one another, and are thereby electrically connected, i.e. via a respective support portion 21 extending transversely to the radiator plane E (FIG. 2), in the embodiment shown extending perpendicularly to the radiator plane E. On consideration of the two dipole components 9, each located on a common side 3, at least approximately in the axial extension, respective dipole components 9, located on a side 3, are mechanically held via two adjacent support portions 21 which, in the final folded position of the radiator, are separated from one another by a slot 30 extending from the top down to the lower base 29, or at least in proximity thereto, thus forming an associated balun 23. On consideration of the four sides 3, there is, therefore, formed for each of the dipole components 9 provided on each side 3, at least substantially or approximately in the axial extension, a balun 23 formed by two adjacent support portions separated from one another by the aforementioned slot 30. The radiator plane E (indicated in FIG. 3) is the plane which conventionally extends parallel to a reflector (not shown in detail in the drawings) and in which there are located the dipoles formed from the dipole components 9. In the second embodiment, the aforementioned feed arms 15, which support and hold the dipole components 9, are also located in the radiator plane E.

As a result of this construction principle, two feed arms 15, which lead to two adjacent feed points 17 in the centre of each side 3 of the dipole arrangement, in which a respective dipole component extends to the remote corner region 5, are positioned parallel to one another in each case. Two feed arms 15 of this type, arranged parallel to one another at a slight distance, form two line halves in which current can flow out of phase, thus ensuring that the line halves themselves do not contribute any significant amount of radiation, as any radiation is eliminated or substantially eliminated by superimposition. Each of the two feed arms 15, arranged parallel to one another at a slight distance, therefore constitutes an asymmetrical line half of a symmetrical line formed from two feed arms 15 arranged in parallel and slightly laterally offset with respect to one another.

In the embodiment shown, the support portions 21 are two-dimensional, i.e. in the embodiment shown formed with a rectangular central portion 21*a*, at the longitudinal region of which, extending perpendicularly to the radiation plane, bending, tilting or folding lines 25 are formed. An edge region 21*b* external to the central portion 21*a* is thus formed on the support portions which, in plan view, are each tilted at a 45° angle toward an associated corner region 5. The central portions 21*a* are thus located parallel to the polarization planes P1 and P2 respectively, i.e. parallel to the diagonal lines or planes extending through the corner regions 5. The edge regions 21*b* adjacent to the bending, tilting or folding lines 25 therefore extend perpendicularly to the associated sides 3, i.e. so as to be located perpendicularly to the associated dipole components 9.

Toward the radiation plane E, in which the dipole halves are positioned, the edge regions 21*b* merge with the aforementioned radially protruding feed arms 15.

At the lower end of the support portions 21, said feed arms 15 are integrally connected, in each case via base edges 27, i.e. base bending, base tilting and/or base folding lines 27, extending parallel to the radiation plane E, to a base 29 which extends perpendicularly to the support portions 21 or the central portion 21*a* and may preferably have at its centre a central recess 31 via which a radiator thus formed may, for example, be screwed onto a reflector.

As may also be seen from the drawings, in the described embodiment according to FIGS. 1 to 4, in the region of the feed points 17, i.e. at the end of the feed arms 15, at the starting region of a respective dipole component 9, there is provided a further bending, tilting and/or folding line 33 via which the respective dipole component 9 is connected to the feed arm 15.

FIG. 4 is a developed view of the cutting or punching circumferential line for producing a vector dipole according to the invention from a flat material, from a plate, strip or film material, in particular a metallic sheet material. The respective parts and bending or tilting lines are also indicated in FIG. 4.

It is clear from FIG. 4 that the construction is optimized for saving material. This optimization concerns the configuration and connection of the dipole components to the feed arms 15 promoting the feeding process.

The dipole components 9, which in the developed view according to FIG. 4 each extend in parallel and in each case to the left or right of an associated support portion (21), are, however, provided so as to extend in parallel orientation only in the developed position, whereas in the final position of a radiator a respective pair of dipole components of this type each extend in pairs toward a common corner region 5.

The dipole components 9*b* and 9*b*' respectively, each of which pertain to the other polarization, could in principle also be provided so as to extend outward from the associated feed arms 15 and be cut or punched from a plate-like material (as was described above with reference to the dipole components 9*a* and is represented in FIG. 4).

Nevertheless, overall this would require more material. In order to reduce the amount of material required, these dipole components 9*c* and 9*d* are, however, provided in the developed position so as to extend toward one another in parallel, the free end regions 9' of the dipole components pertaining to this second polarization plane ending directly adjacent to the support portion 21 pertaining to the other polarization.

As a result, as is particularly apparent from the perspective view according to FIG. 1, the dipole components 9*a* and 9*a*' shown in FIG. 1, for example, are curved about a bending edge or radius 33 located below the associated feed arm 15 and extending parallel to the feed arm 15, whereas the dipole components 9*b* and 9*b*' are curved about a bending edge or radius 33' located above the associated feed arm 15 or also extending parallel thereto.

However, as the bending radii at the bending edges 33 are very small, the dipole components 9 are positioned practically at the same height, or almost at the same height, parallel to the radiation plane E.

In the illustrated arrangement of the bending and folding edges, the dipole components 9, with their flat web material, are oriented parallel to the radiation plane E whereas the feed arms 15, with their web material, extend perpendicularly thereto, also like the support portions 21.

Figure 5:
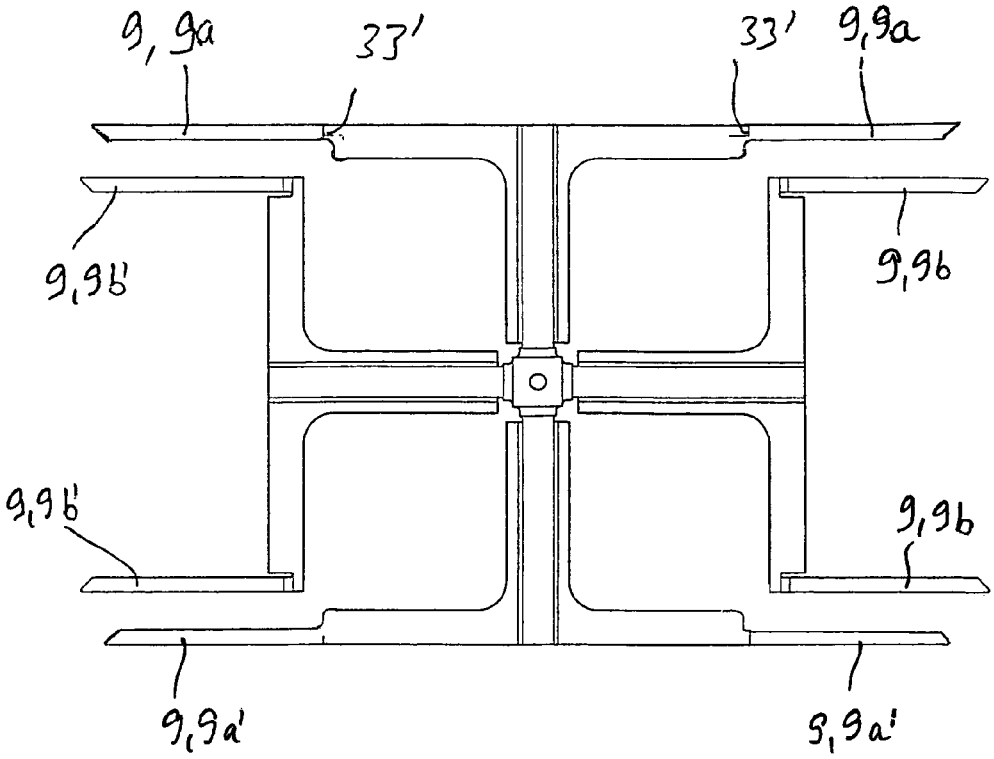
FIG. 5 shows an embodiment modified from FIG. 4.

FIG. 5 shows a modification to the extent that in this case, in the developed position, the dipole components 9*b*, 9*b*' extend in the extension of the feed arms 15 and therefore the bending edge or line 33' extends perpendicularly to the direction of the extension of the respectively associated feed arm 15.

In the assembled position, this would cause the dipole components 9, with their web material, then to be positioned, with respect to the one polarization P2, perpendicularly to the embodiment according to FIG. 1, because the associated bending edge between the dipole components 9 and the associated feed arms 15 carrying them would extend parallel to both.

For the sake of clarity of the illustrated drawings, the coaxial feed lines provided for each polarization have been omitted. Conventionally, these coaxial feed lines are guided upward on the respective support portion 21 or between the support portions 21, originating from the back of a reflector, wherein for each polarization the outer conductor at the upper end of the support portion is electrogalvanically connected, as is the inner conductor of the upper end of the support portion, diametrically opposing the first-mentioned support portion via which the dipole components 9 extending toward a common corner point 5 are therefore supported. The two further dipole components, located offset with respect to the support portions 21 by 90°, are fed accordingly via the second coaxial line for the second polarization, i.e. in that the outer conductor of a feed line is preferably electrogalvanically connected to a support portion 21 at the upper end thereof, whereas the inner conductor is electrogalvanically connected to the diametrically opposed second support portion 21, also in the upper region, i.e. at the height of the dipole components 9, thus producing radiation in the second polarization plane.

Figure 6:
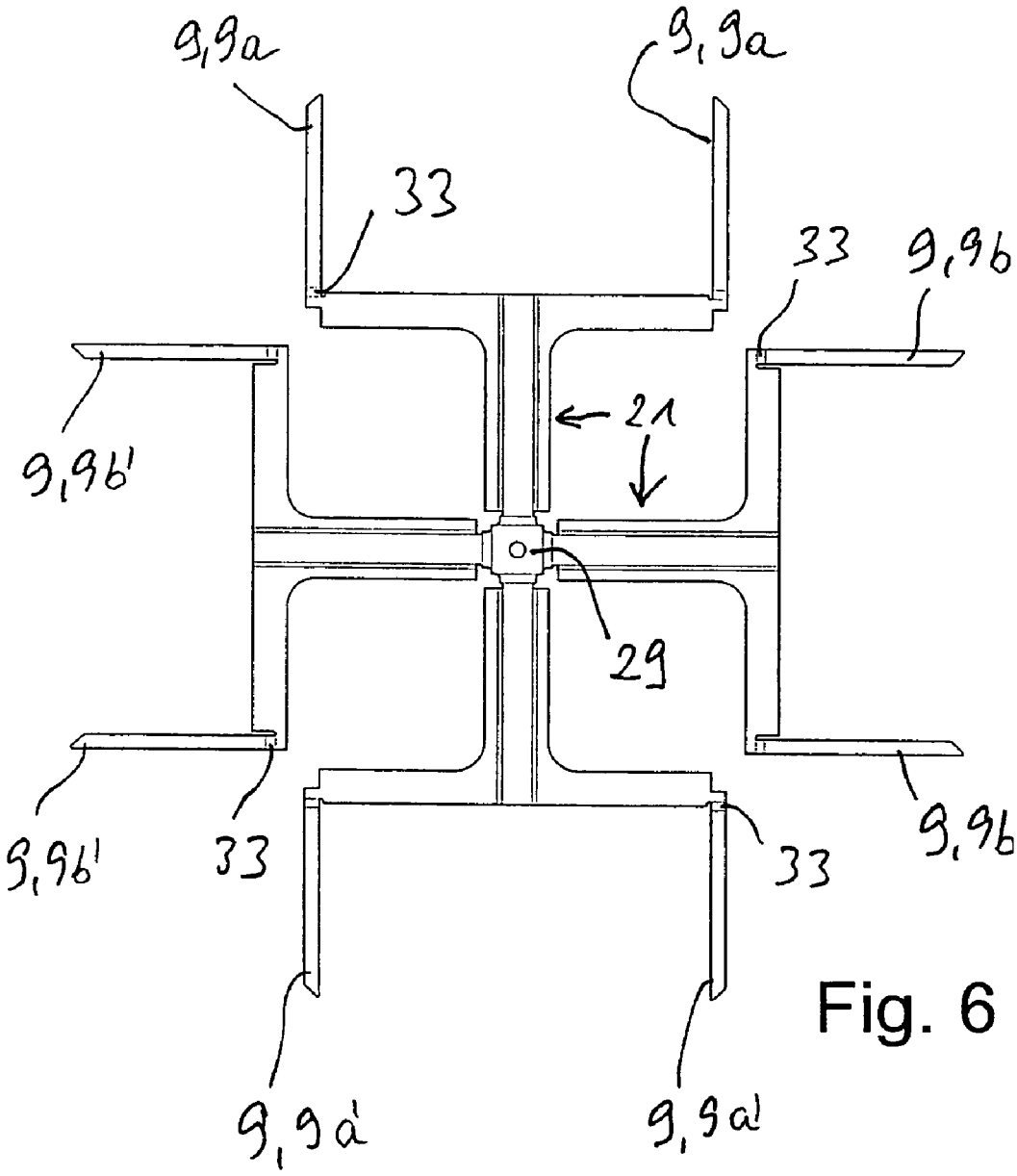
FIG. 6 is a plan view of an embodiment modified from FIG. 4.

FIG. 6 shows a further modified embodiment which is substantially similar to that according to FIG. 4. However, in contrast to FIG. 4, the dipole components 9*b* and 9*b*' are oriented so as to extend away from one another, rather than toward one another, so the support portions 21, the adjacent feed arms 15 and the dipole components 9*b* and 9*b*' respectively, held thereby, are identical in the construction to the further support portions which are arranged rotated by 90° and have the adjacent feed arms 15 leading to the dipole components 9*a* and 9*a*' respectively. For this reason, the bending edges or bending radii 33 are also all configured so as to extend in the same direction and are located above the feed arms 15. This embodiment therefore involves a greater amount of material waste when it is punched or cut in the developed position from the electrically conductive metal sheet.

Reference will be made hereinafter to a further modified embodiment according to FIGS. 7 and 8.

Figure 7:
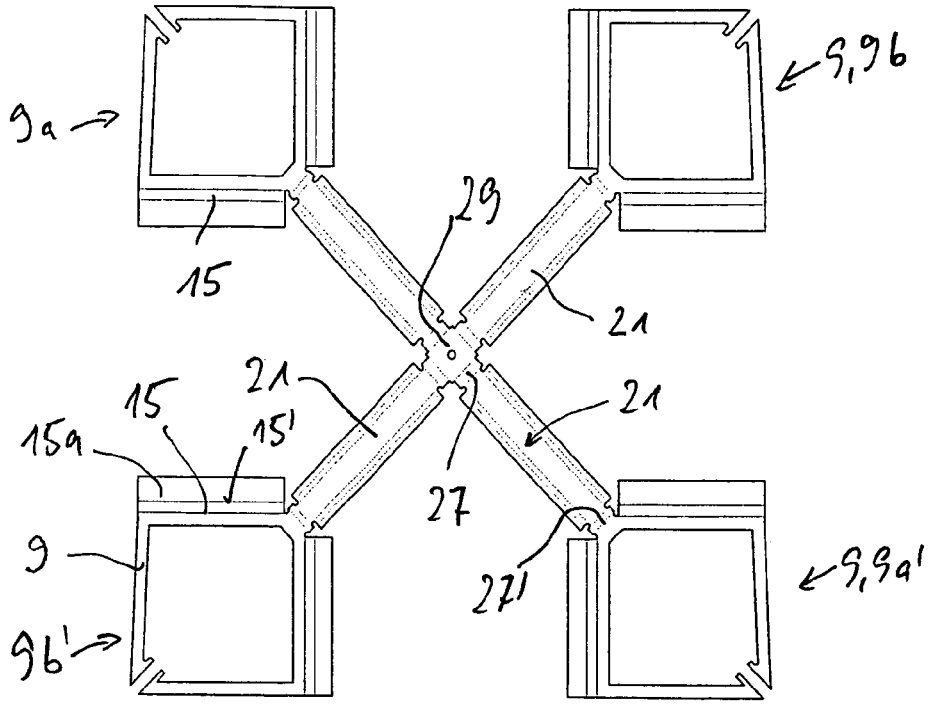
FIG. 7 shows a further modified embodiment according to the invention, in the developed position after a punching or cutting process.
Figure 8:
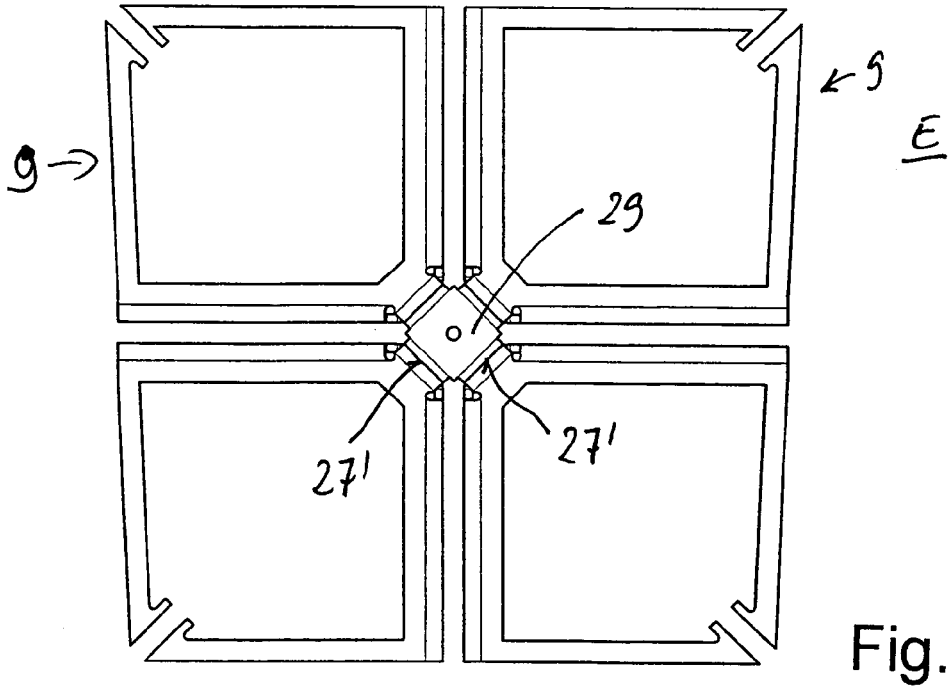
FIG. 8 is a corresponding plan view of the embodiment according to FIG. 7, once the folding process has been completed.

In this embodiment according to FIGS. 7 and 8, there are provided adjacent to the base 29—again, offset by 90° with respect to one another—the support portions 21 which, after the cutting or punching process, are bent from a flat metal sheet, preferably by 90° about a respective lower base bending edge 27 with respect to the plane of the base 29.

Via an upper counter-bending edge 27' parallel to the lower base bending edge 27, there is then provided a dipole half 9*a*, 9*a*' or 9*b*, 9*b*' located in a single plane. In this case, the feed arms 15 and the dipole components 9 are punched from a common two-dimensional portion of a two-dimensional basic material and are therefore located in the radiation plane E in the final tilted and assembled condition.

For achieving increased reinforcement, there is provided—extending respectively in the longitudinal direction of the feed arms 15—a further bending edge 15', ultimately forming a feed portion 15*a* which is positioned on an adjacent feed portion 15*a* of an adjacent dipole component and is oriented, for example, perpendicularly to the radiator plane when the radiation is finally produced. As may be inferred at least indirectly from the final tilted vector dipole according to FIG. 8, the feed arms 15, which are directly adjacent to one another, then extend, with their plane extending perpendicularly to the radiation plane E, directly parallel to one another.

In this embodiment, a respective dipole component 9 is therefore oriented, with the feed arm 15 carrying it, at an angle of +45° or −45° with respect to the support portion carrying it (after the punching or cutting process and prior to tilting), thus providing a unit which acts electrically as a complete dipole half and comprises two feed arms 15, which extend perpendicularly to one another and are mechanically and electrically connected to one another and to the associated support portion 21, and the associated dipole components 9 extending perpendicularly thereto. Each unit 9 is curved about an upper bending line 27' with respect to the associated support portion 21, all of the units thus formed being located in the same plane.

Figure 9:
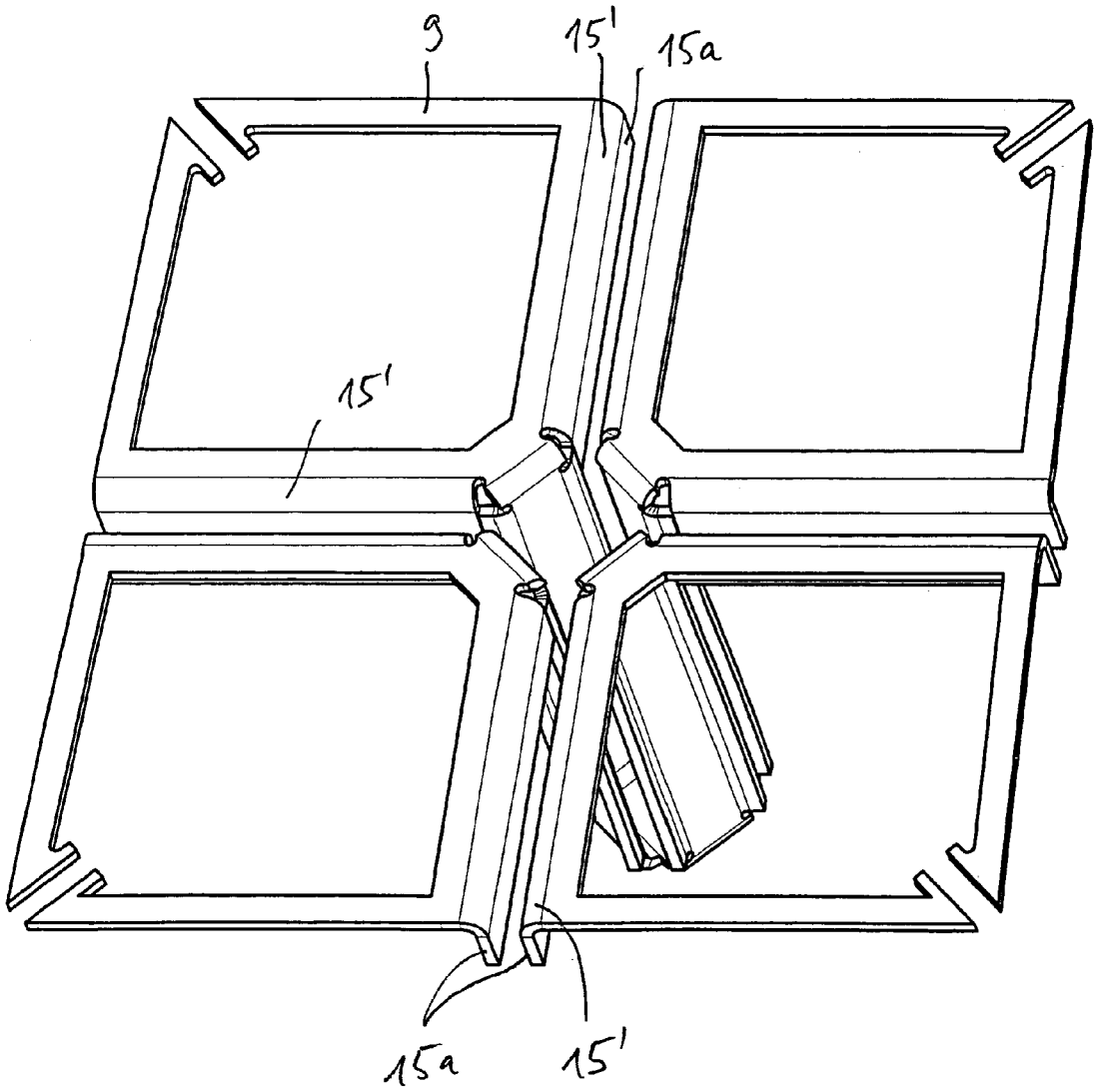
FIG. 9 is a three-dimensional representation of the embodiment according to FIGS. 7 and 8.

FIG. 9 is a three-dimensional representation of the embodiment according to FIGS. 7 and 8.

This embodiment can, in principle, be subjected to certain further modifications.

Figure 10:
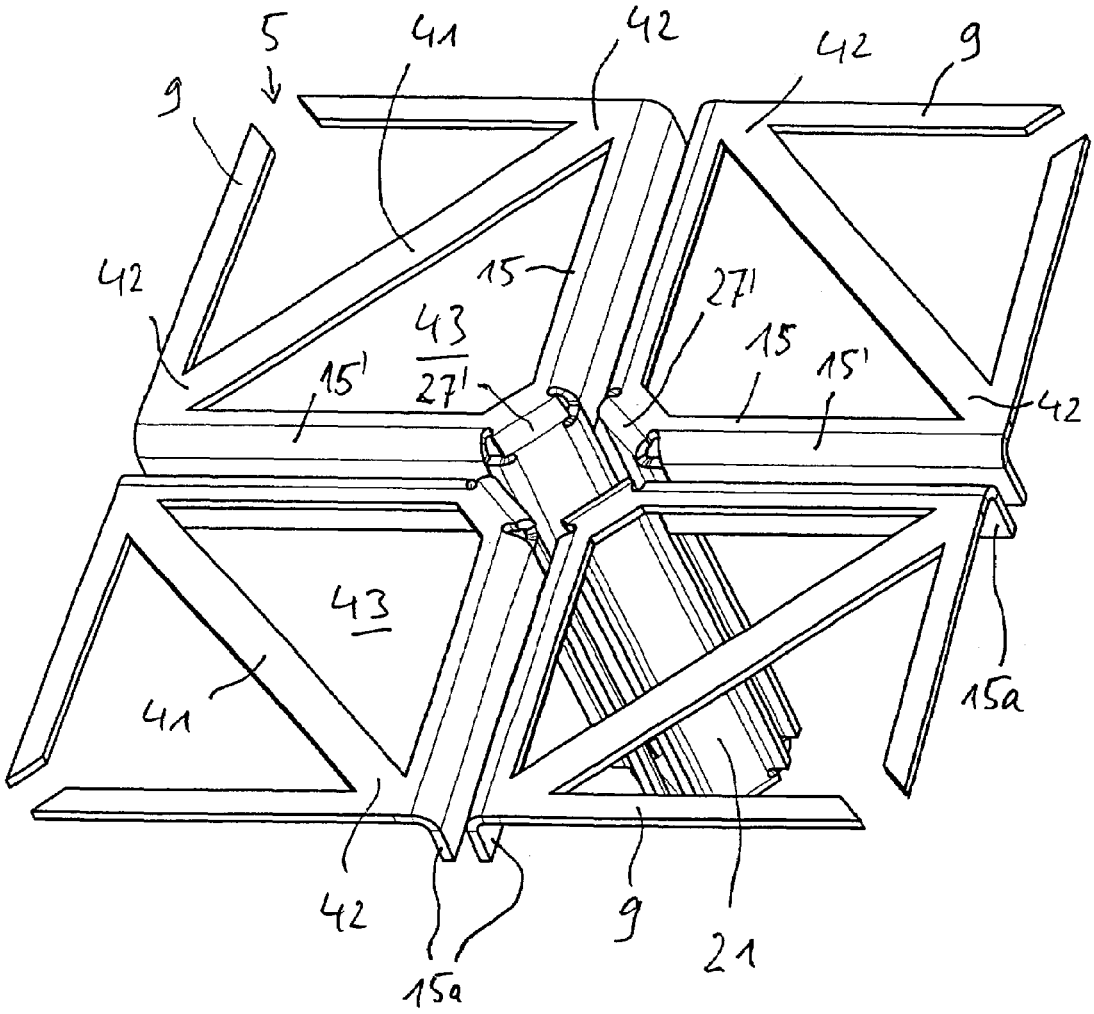
FIG. 10 shows an embodiment modified from FIG. 9, with additional cross connection struts and open corner regions.

The three-dimensional representation according to FIG. 10 thus shows, for example, what is known as a dual polarized antenna element or a dual polarized radiator of a vector dipole type, the dipole components of which end in the corner region 5 at least at a slight distance from one another (i.e. in this case are not electrogalvanically connected to one another), wherein transverse to the polarization plane there is provided, in each case, a connection or a connection web 41 which electrogalvanically connects the dipole components 9 provided in a quadrant and extending toward a common corner region 5. The connection point 42 may, in this case, be provided so as to be positioned offset with respect to the corner region 5 on the respective dipole components and/or on each support arm 15.

In this arrangement, there is provided an enclosed opening region 43 which, unlike in FIG. 10, may also be configured as an electrogalvanic closed surface.

This embodiment may also be punched from a strip or plate material, the cross connection 41 and the dipole components 9, in this embodiment, and parts of the support arms 15, in the second embodiment, also being located in the common plane E.

Figure 11:
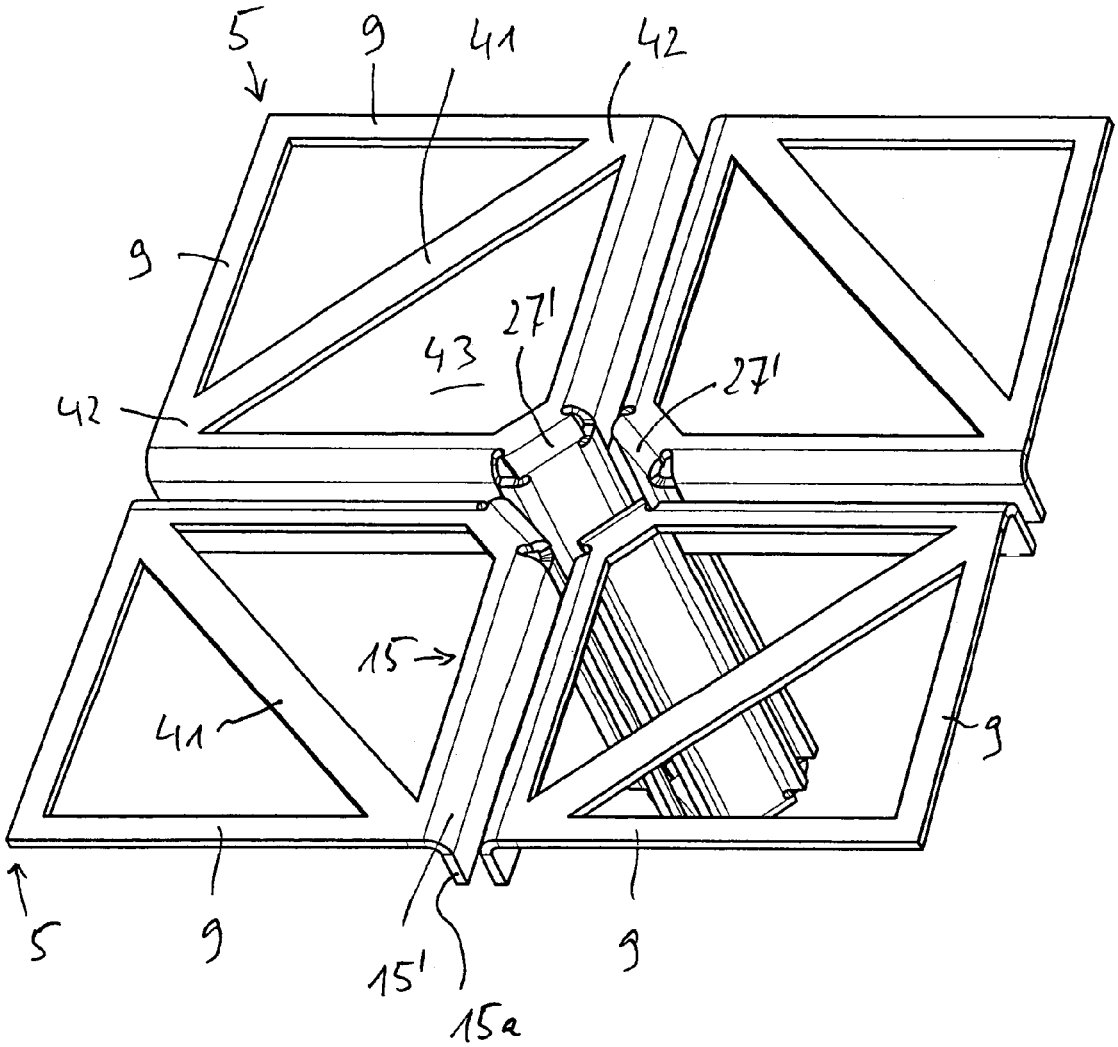
FIG. 11 shows an embodiment modified from FIG. 10, with closed corner regions.

The embodiment according to FIG. 11 merely shows that the dipole components 9 may also be connected to one another in their corner region 5 not only mechanically but also electrogalvanically, i.e. the corner region 5 is closed.

Figure 12:
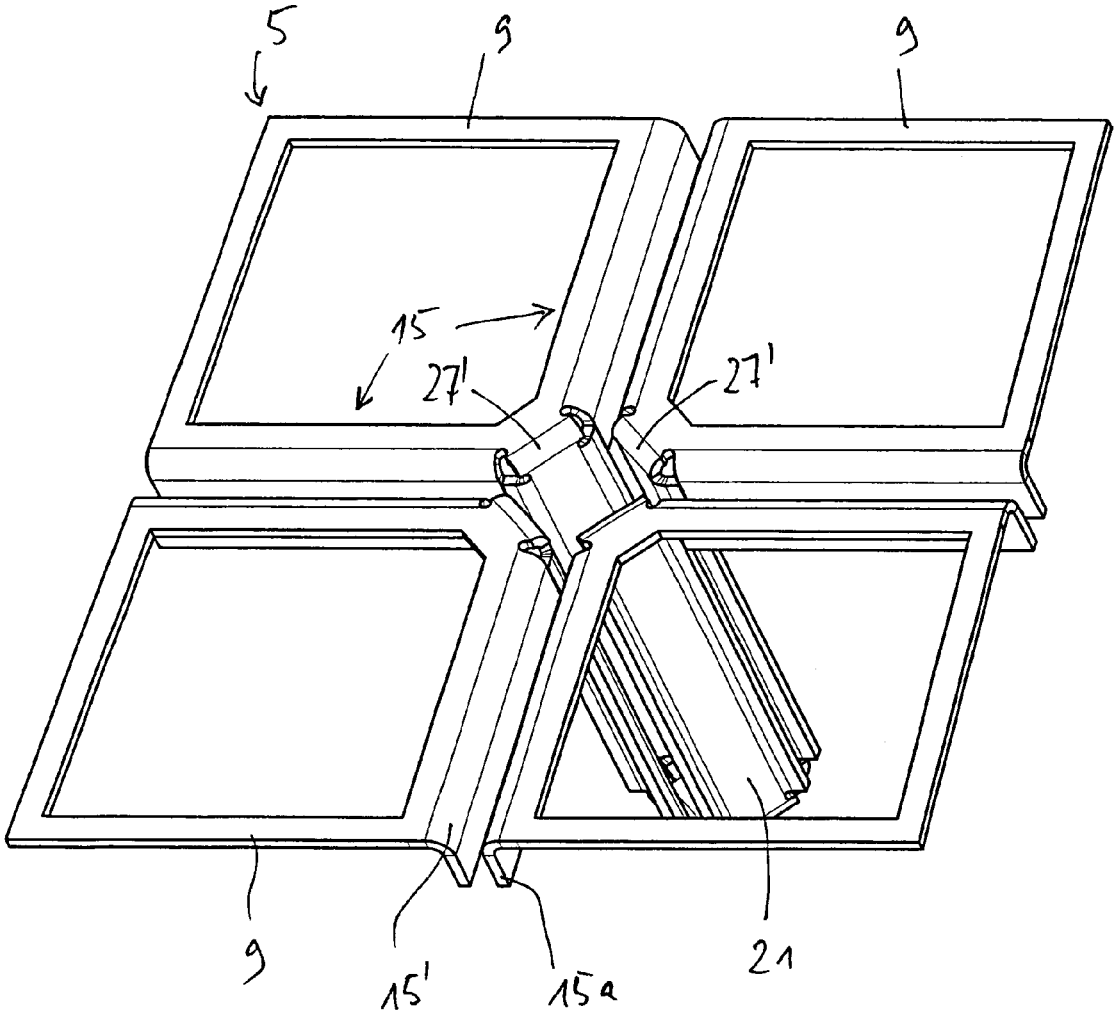
FIG. 12 is a three-dimensional representation of a further modified embodiment, with closed corner regions but without connection struts.

The fact that the aforementioned connections or connection struts 41 may also be dispensed with in the embodiment according to FIG. 11 is, in principle, reflected in the embodiment shown in the perspective or three-dimensional representation according to FIG. 12.

Figure 13:
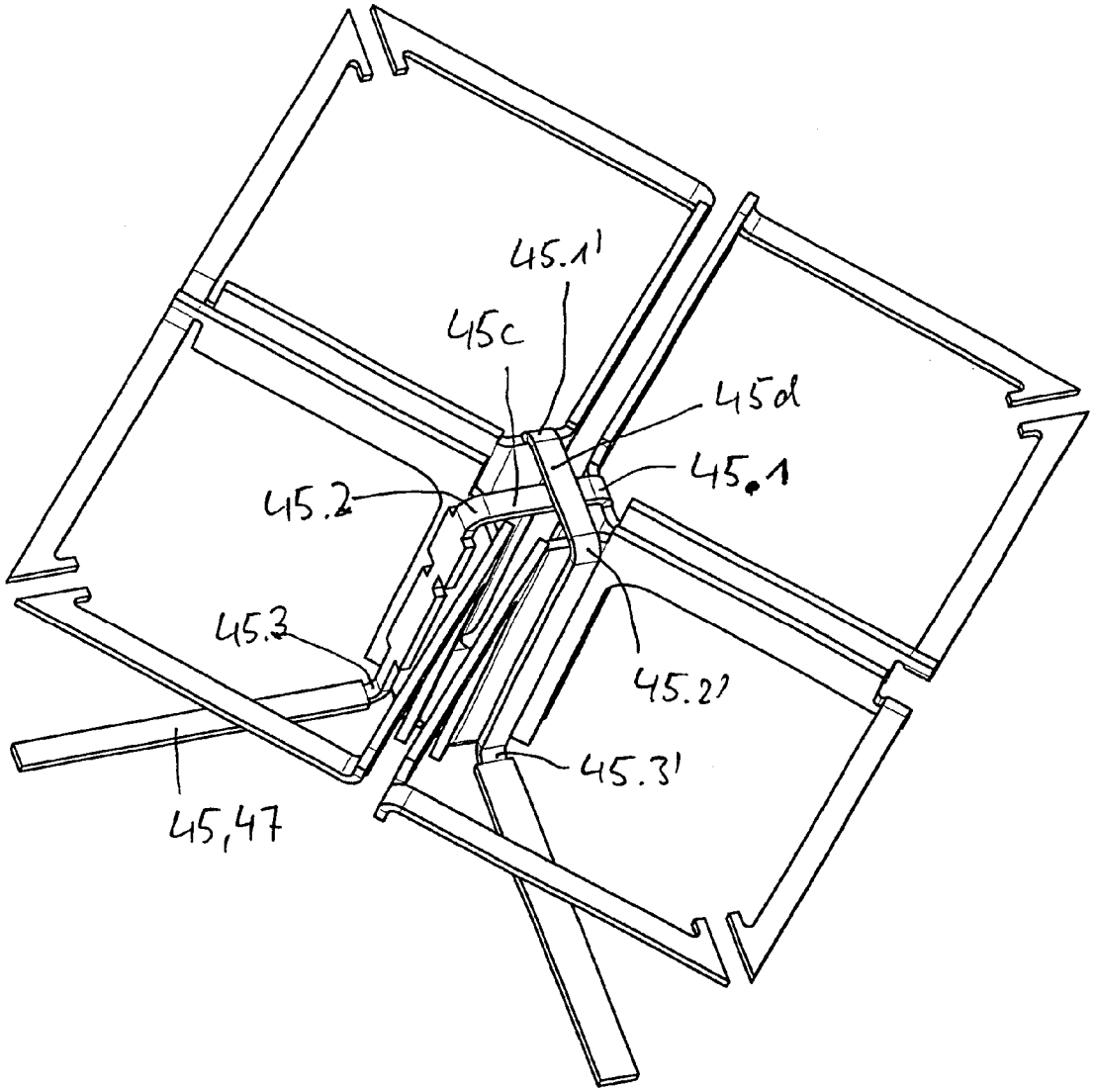
FIG. 13 shows a perspective embodiment comparable to that according to FIGS. 7 to 9, with feed lines constructed in one piece for each polarization.

Finally, FIG. 13 illustrates still another development, for example on the basis of the embodiment according to FIGS. 7 to 9, which is also provided with a one-piece feed means which is also punched out and folded.

As may be seen from the embodiment shown in a three-dimensional reproduction in FIG. 12 and in a developed view in FIG. 13, in two respective support portions 21, positioned offset with respect to one another by 90° in development, of the side, opposing the base 29, of the support portion 21, a metal strip 45, which may be broken down in the longitudinal direction into different portions of different widths, is also punched out.

A metal strip 45 thus formed serves as a feed line 47, as emerges in particular from the three-dimensional representation according to FIG. 13.

Figure 14:
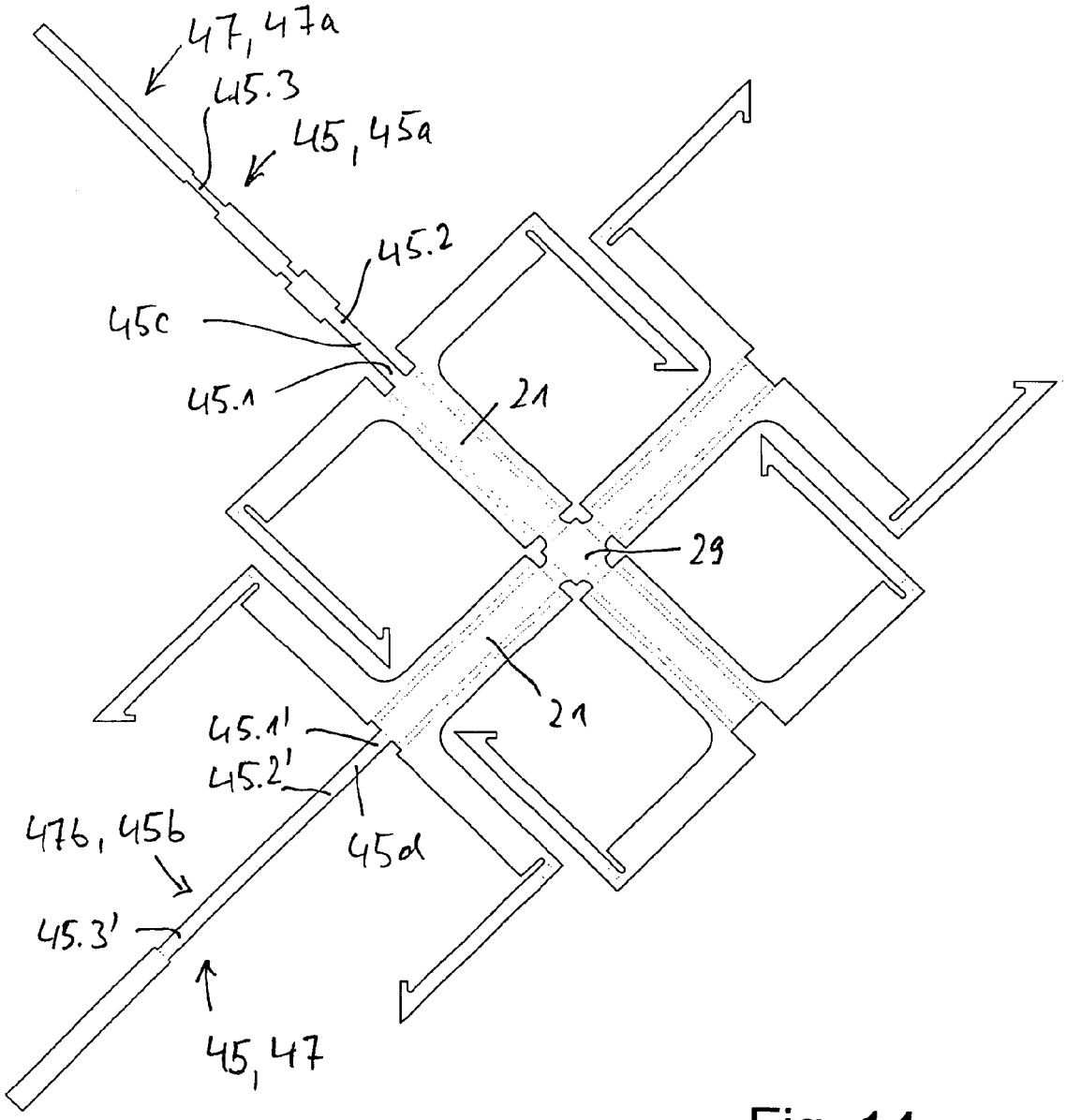
FIG. 14 is a view of the antenna according to FIG. 13, but in the developed position corresponding to a punch diagram to be carried out.

The one metal strip 45, 45*a* shown in FIG. 14 is tilted, in the region of the upper end of the support portion 21, about a first edge 45.1 in a position parallel to the base 29 (i.e. parallel to the radiator plane E and therefore generally parallel to a reflector in the region of the base 29) in order then, after overlapping the opposing support portion 21 at a distance before this support portion, to extend down toward the base 29 in parallel before this support portion 21 after passing through a further 90° fold 45.2.

Approximately at the height of the base 29, or slightly thereabove, there is then formed, again via an opposing 90° fold 45.3, the metal strip 45 acting accordingly as the feed line 47, conventionally parallel to the base 29 and therefore parallel to a reflector carrying the radiator means, the base of the radiator thus cut being positioned on the reflector and preferably electrogalvanically or capacitively connected thereto.

FIGS. 13 and 14 also show that a second metal strip 45*b* is displaced from the support portion 21, offset by 90°, also at the end opposing the base 29, forming corresponding bendings and tiltings or foldings, thereby forming in the centre of the radiator thus formed intersection portions 45*c* and 45*d* which intersect at a vertical distance and are thus electrogalvanically isolated from one another. Feeding with respect to the two polarizations therefore ensues via these two feed lines 47*a* and 47*b*.

This second metal strip 45*b* acting as the second feed line 47*b*, for its part, also has three preferably 90° tiltings, namely a tilting 45.1', a further tilting 45.2' and a third opposing 90° tilting 45.3', thus producing an otherwise similar profile to that of the first metal strip 45*a*.

The varying configuration in the varying width of the metal strips 45 and therefore of the feed line 47 allows corresponding adaptation and adjustment to be carried out.

Figure 15:
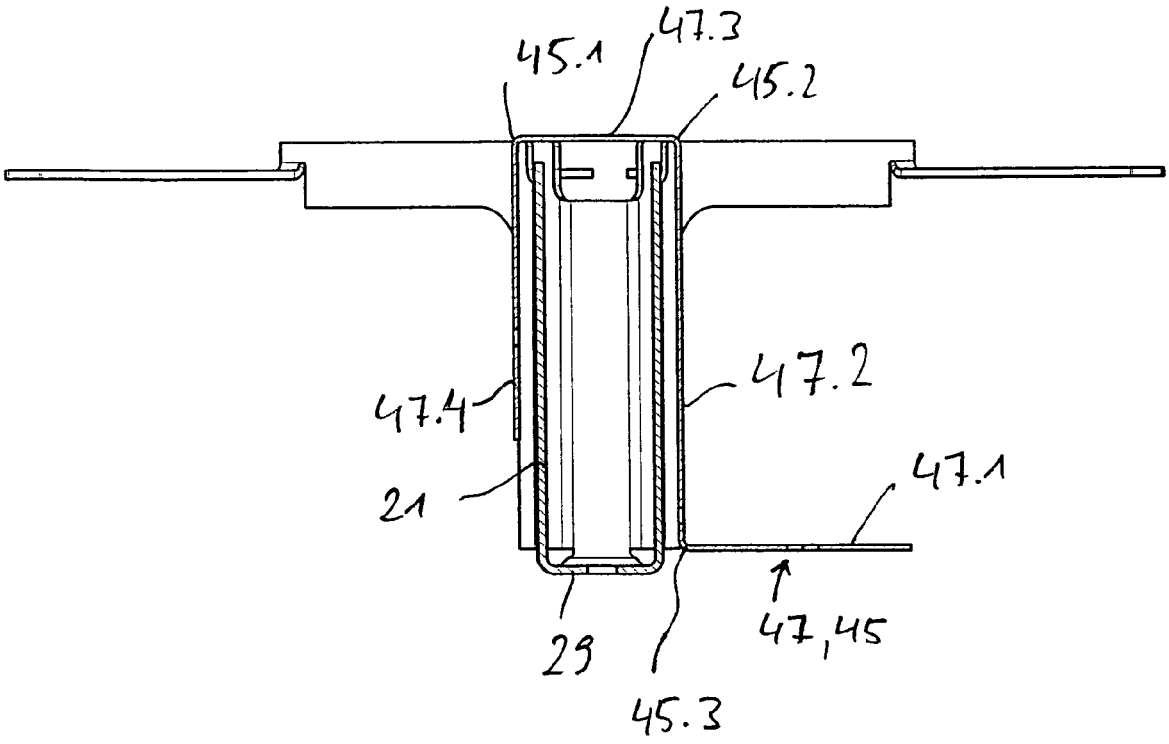
FIG. 15 is a vertical cross section through a modified embodiment with a capacitive coupling.

Finally, FIG. 15 shows how, in accordance with the invention, a capacitive coupling may also be produced.

For this purpose, a corresponding radiator arrangement, comparable to that according to FIG. 13, is reproduced in vertical section. For the one polarization, there is shown a feed line 47, again also using a metal strip 45, a corresponding feed line portion 47.1 merging with a vertically extending second feed line portion 47.2 extending before a support portion 21, at a distance thereto, forming a first formation 45.3. Above the antenna element or the dipole components 9 and, in particular, the support portions 21, it is then ensured via a 90° tilting or folding 45.2 that the metal strip 45 merges with a conduction portion 47.3 more or less parallel to the base 29. Via a subsequent 90° tilting or folding 45.1 there is then arranged a corresponding feed portion 47.4 extending downward at a distance before a support portion 21 in the direction parallel to the support portion 21 which ends above the base 29, i.e. is formed only over a partial length with respect to the length of the support portions 21. This produces a capacitive coupling of the conduction portion 47.3 to the adjacent support portion 21, via which the dipole components 9 held thereby are finally fed.

The invention claimed is:

1. A dual polarized dipole radiator which radiates in two polarization planes (P1, P2) located perpendicularly or substantially perpendicularly to one another, the dual polarized dipole radiator being structurally formed in the manner of a dipole square having four sides, each side of the dipole radiator formed in the manner of a dipole square comprising between two corner points two dipole components which, in plan view, are oriented at least approximately in the axial extension, the polarization planes (P1, P2) passing, in each case, through an opposing pair of corner points, two respective dipole components extending toward a common corner point being held via two feed arms and supplied with electricity, at a feed point provided on the respective dipole component, opposing an associated corner region, the two respective feed arms, which lead to two dipole components provided on a side of the radiator at the respective feed points, being arranged substantially in parallel, the respective dipole components extending toward a common corner region and the feed arms connected thereto, each feed arm extending at least substantially perpendicularly to the associated dipole component, and each connected to a support portion extending transversely and perpendicularly to a radiation plane E, two respective adjacent support portions each forming between them a balun with a slot, the dual polarized dipole radiator comprising:

a strip and/or board material, the dual polarized dipole radiator being constructed in one piece from said strip and/or board material, and individual portions of the dual polarized dipole radiator, including the dipole components, the feed arms, the support portions forming a balun and an associated base connecting the support portions, being connected to one another by bending and/or tilting and/or folding lines formed in the strip and/or board material.

2. The dual polarized radiator as claimed in claim 1, further comprising two respective pairs of bending or tilting or folding lines, arranged parallel to one another and laterally offset with respect to one another, provided on the base, a first pair of support portions, which extend transversely and, perpendicularly to the plane of the base; and at the ends of which opposing the base there are provided the dipole components for the first polarization plane provided at the ends of said base opposing first pair of supports, adjacent to the first pair of parallel bending, tilting or folding lines, and a further pair of support portions, which, at their ends opposing the base, have the dipole components for the second polarization plane, adjacent to the second pair of bending lines, which are offset by 90°.

3. The dual polarized radiator as claimed in claim 1, wherein the support portions extending substantially perpendicularly to the base have, in the direction of extension of the support portions, a bending edge extending to the left and a bending edge extending to the right thereof, thus forming a centre central portion and an edge region laterally adjacent to the bending edges, the bending edge providing a connection to the base being formed in the region of the central portion.

4. The dual polarized radiator as claimed in claim 3, wherein the edge regions at their end opposing the base comprise feed arms extending transversely and perpendicularly to the direction of extension of the support portion and protruding beyond the edge region.

5. The dual polarized radiator as claimed in claim 1, wherein at the outer end, remote from the balun, of the feed arms there is formed a bending axis via which the dipole components thereby held are oriented in the direction transverse and in the direction perpendicular to the feed arm.

6. The dual polarized radiator as claimed in claim 5, wherein the bending, tilting or folding line connecting the feed arm and the associated dipole component extends parallel to the direction of extension of the feed arm.

7. The dual polarized radiator as claimed in claim 5, wherein the bending, tilting or folding line connecting the feed arm and the associated dipole component extends perpendicularly to the direction of extension of the feed arm.

8. The dual polarized radiator as claimed in claim 1, wherein all of the dipole components are oriented parallel to one another.

9. The dual polarized radiator as claimed in claim 1, wherein half of all of the dipole components are oriented in one direction and the other half are oriented in a direction perpendicular thereto.

10. The dual polarized radiator as claimed in claim 9, wherein half of all of the dipole components of the feed arm carrying them extend away from one another in opposing directions and the other half of the dipole components of the feed arm carrying them extend toward one another.

11. The dual polarized radiator as claimed in claim 10, wherein the dipole components extending toward one another end at a slight distance before those support portions which lead to the feed arms via which the dipole components extending away from one another are carried.

12. The dual polarized radiator as claimed in claim 8, wherein all of the dipole components are positioned in such a way that their free ends are located further away from the base than are their feed points at the end of the feed arms carrying them.

13. The dual polarized radiator as claimed in claim 1, wherein the dipole components, which extend toward a common corner region and are each mechanically and electrically connected to an associated support portion via a feed arm, are also arranged in developed form in such a way that these dipole components extend perpendicularly to one another toward a common corner region and are connected, opposing the corner region, to a respective feed arm located at least substantially perpendicularly to said components, the arrangement thus formed being provided on its connection portion, at the point at which it meets the associated support portion, with an upper bending edge, this bending edge being located parallel to the bending edge formed on the bottom of the base or adjacent to the base.

14. The dual polarized radiator as claimed in claim 13, wherein the two feed arms, located perpendicularly to one another and jointly connected via an upper bending edge, and the dipole components thereby held and extending toward a common corner region are two-dimensional in their construction without a further bending edge being formed therebetween.

15. The dual polarized radiator as claimed in claim 13, wherein there is formed a bending edge which extends in the longitudinal direction of the feed arms and above which there is provided a portion which is curved with respect to the two-dimensional plane of the feed arm and is positioned, in the final position of the radiator, directly adjacent and parallel to a portion of an adjacent feed arm of an adjacent dipole half.

16. The dual polarized radiator as claimed in claim 13, wherein the dipole components extending toward a common corner region are integrally and continuously connected to one another at the corner region.

17. The dual polarized radiator as claimed in claim 13, further comprising a cross connection which additionally connects two dipole components extending toward a common corner region and the connection point so as to be offset with respect to the corner region, on an associated dipole component and/or on one of the feed arms carrying the respective dipole component.

18. The dual polarized radiator as claimed in claim 17, wherein the region between the support portions and the cross connection is closed over all of its surface area.

19. The dual polarized radiator as claimed in claim 13, wherein the region between the connection strut and the associated support portion has at least one opening.

20. The dual polarized radiator as claimed in claim 1, wherein a metal strip acting as a feed line is formed on at least two support portions, offset with respect to one another by 90°, at the end thereof opposing the base, in the developed position, in the axial extension of the support portions.

21. The dual polarized radiator as claimed in claim 20, wherein the metal strip is curved by a first, 90°, tilting in such a way that a first metal strip portion extends beyond the upper end of the opposing support portion without contact therewith.

22. The dual polarized radiator as claimed in claim 21, wherein, via a second tilting, a 90°, tilting, the metal strip merges with a second metal strip portion which is led down toward the base at a distance from the opposing support portion.

23. The dual polarized radiator as claimed in claim 22, wherein, via a further, 90°, tilting, the metal strip is angled so as to extend in a position parallel to the base.

24. The dual polarized radiator as claimed in claim 23, wherein there are provided two metal strips which emerge from two support portions offset with respect to one another by 90°, at the end thereof opposing the base, and which intersect in a contactless manner, in plan view of the radiator thus formed, forming two intersection portions.

25. The dual polarized radiator as claimed in claim 1, wherein there is provided a capacitive coupling, in the form of a metal strip which is led upward beyond a conduction portion at a distance before a first support portion, at the upper end via this first support portion and a second support portion diametrically opposing said first support portion, and, at a distance before the second support portion, is in turn configured and/or arranged so as to extend downward, parallel to said second support portion, via which metal strip the capacitive coupling is produced.

26. A dual polarized dipole radiator antenna comprising:

a metal sheet bent and formed to provide a four-sided dual polarized dipole square radiator, said metal sheet providing two respective dipole components extending toward a common corner point being held via two feed arms and supplied with electricity, at a feed point provided on the respective dipole component, opposing an associated corner region, the two respective feed arms, which lead to two dipole components provided on a side of the radiator at the respective feed points, being arranged substantially in parallel, the respective dipole components extending toward a common corner region and the feed arms connected thereto, each feed arm extending at least substantially perpendicularly to the associated dipole component, and each connected to a support portion extending transversely and perpendicularly to a radiation plane E, two respective adiacent support portions each forming between them a balun with a slot formed integrally in said sheet, wherein the balun is coupled to said feed arms, said balun formed integrally to said metal sheet by at least one of bending, tilting and folding lines on said sheet.

* * * * *